US005915667A

United States Patent [19]

Kim et al.

[11] Patent Number: 5,915,667

[45] Date of Patent: Jun. 29, 1999

[54] PROPORTIONAL SOLENOID VALVE CONTROL SYSTEM

[75] Inventors: Yong-Ho Kim, Seoul; Young-Sik Lee, Anyang; Hee Chun, Seoul, all of Rep. of Korea

[73] Assignee: Samsung Electronics Co., Ltd., Suwon, Rep. of Korea

[21] Appl. No.: 08/584,212

[22] Filed: Jan. 4, 1996

[30] Foreign Application Priority Data

Apr. 30, 1995 [KR] Rep. of Korea ..... 95-10090

[51] Int. Cl.[6] ..... H01F 7/18

[52] U.S. Cl. ..... 251/129.08; 361/152

[58] Field of Search ..... 251/129.08, 129.05; 361/152, 153

[56] References Cited

U.S. PATENT DOCUMENTS

| | | | |
|---|---|---|---|
| 4,485,424 | 11/1984 | Niwa et al. | 361/152 |
| 4,848,101 | 7/1989 | Suzuki | 251/129.08 X |
| 5,724,223 | 3/1998 | Feuser et al. | 361/152 |

OTHER PUBLICATIONS

New Options for Hydraulic System Control, Richard Beercheck, Mar. 22, 1984, pp. 77–81.

Proportional–Solenoid Valves, New Option for Hydraulic control, Denis L Royston, Feb. 24, 1983, pp. 69–72.

*Primary Examiner*—Kevin Lee

*Attorney, Agent, or Firm*—Pillsbury Madison & Sutro LLP

[57] ABSTRACT

A proportional solenoid valve control system is applicable to hydraulic systems of heavy equipment, automatic transmission systems and furl injectors of vehicles. This system includes main circuitry which is composed of a switching element, a proportional solenoid valves, and a current detection resistor; and a control circuit which is composed of a current command detection circuit, a rectifier, an offset circuit, a current command adding and limiting circuit, an offset circuit, a current command adding and limiting circuit, a current detection circuit, an proportional integrator-controller, a pulse width modulation comparator, and an output circuit. In addition, the system, precisely controls the load currents flowing in the proportional solenoid valves according to the current commend.

13 Claims, 6 Drawing Sheets

PROPORTIONAL SOLENOID VALVE CONTROL SYSTEM

BACKGROUND OF THE INVENTION (1) Field of the Invention

The present invention relates to a proportional solenoid valve control system which is applicable, for example, to hydraulic systems used in heavy equipment, automatic transmission systems, and vehicle fuel injectors.

(2) Description of the Prior Art

A proportional solenoid valve is described in *Machine Design,* pp. 69–72, February 1983. A new option for hydraulic system control is also described in *Machine Design,* pp. 77–81, March 1984.

According to the above-identified documents, proportional solenoid valves were developed to fill the gap between servovalves and conventional on/off solenoid valves. An electronically controlled proportional solenoid valve can proportionally control a hydraulic system relative to an on/off solenoid valve, and has a lower cost and simpler control system relative to a servovalve.

In particular, while a servovalve has a minimal deadband, and a faster response time and frequency response, it is five times more expensive than a proportional solenoid valve. An on/off solenoid valve is half the cost of a proportional solenoid valve, however, it can only control the on/off operation of a hydraulic system.

It is desirable that a proportional solenoid valve have a control performance equal to that of a servovalve.

In addition, to reduce power consumption, a pulse width modulation technique is adapted to the driving circuit of the proportional solenoid valve.

SUMMARY OF THE INVENTION

An object of the present invention is to provide a proportional solenoid valve control system for precisely controlling current flowing in a proportional solenoid valve according to a current command.

Another object of the present invention is to provide a proportional solenoid valve control system for applying accurately an external current command to a control circuit by current command detection and rectification.

A further object of the present invention is to provide proportional solenoid valve control system for maintaining constant current flowing in its two loads.

A still further object of the present invention is to provide a proportional solenoid valve for limiting the current command if an external current command higher than a fixed value is applied to the control circuit.

In order to achieve these objects, the proportional solenoid valve control system of the present invention comprises: a current command detection circuit for detecting a current command inputted from outside by using a voltage value; a rectifier for rectifying the current command detected by the current command detection circuit; an offset circuit for generating an offset signal through the output signal of the rectifier; a current command adding and limiting circuit for adding the output signal of the offset circuit and a triangular pulse signal generated from a second triangular pulse generating circuit; a current detection circuit for detecting current flowing in each load of a main circuitry; a proportional integrator-controller (hereinafter referred to as a PI controller) for amplifying an error between the output signal of the current command adding and limiting circuit and the output signal of the current detection circuit; a pulse width modulation comparator for comparing the output signal of the PI controller with the output signal of a first triangular pulse generating circuit; and an output circuit for generating a switching element driving signal having a duty ratio corresponding to the output signal of the pulse width modulation comparator.

The proportional solenoid valve control system further includes a current command mode determining circuit. The current command-mode determining circuit, located between the rectifier and the output circuit, receives the output signal of the rectifier as an input, determines an operating mode for controlling current flowing in the load of the main circuitry, and transmits the determined operating mode to the output circuit.

DETAILED DESCRIPTION OF THE INVENTION

Figure 1:
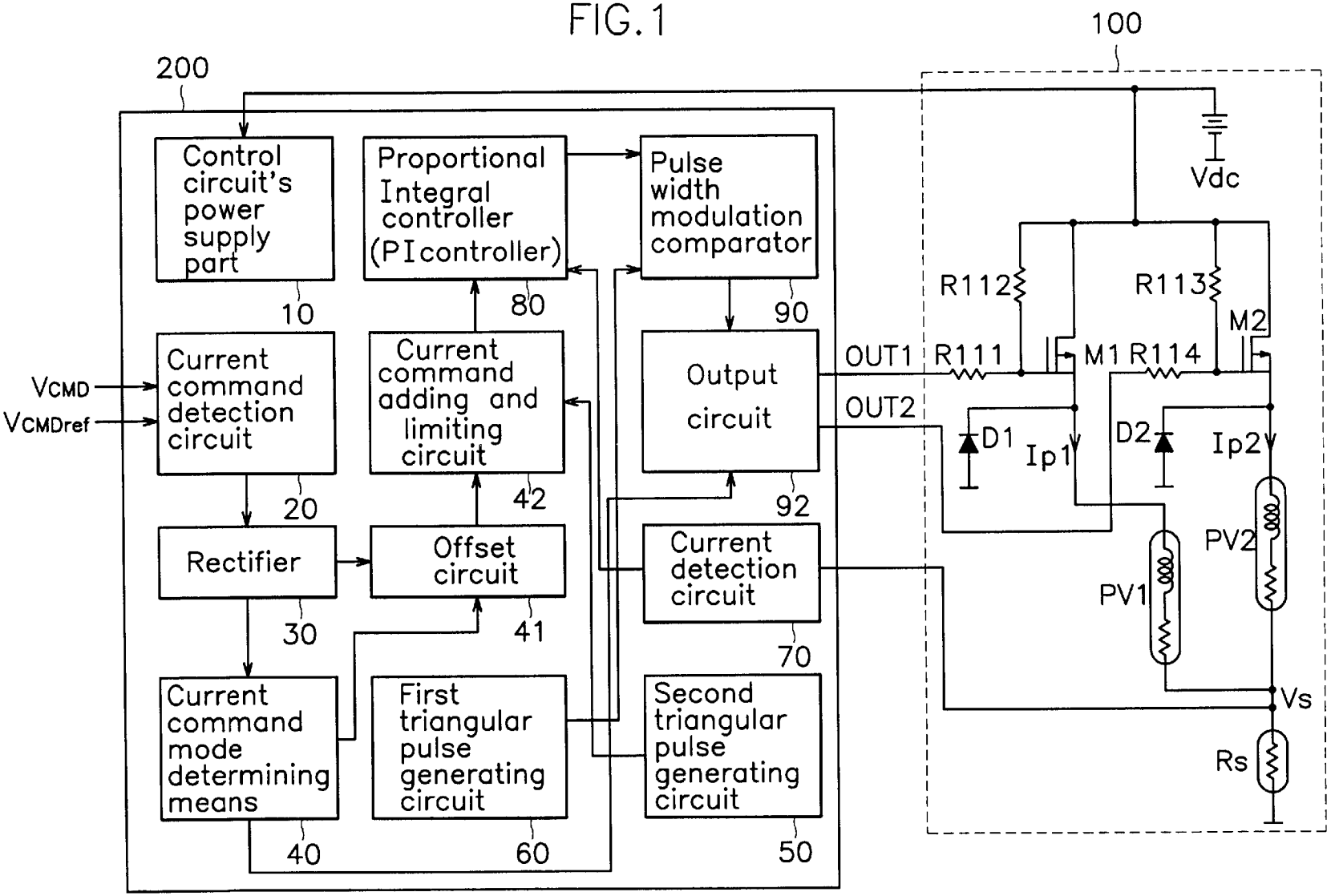
FIG. 1 is a block diagram of a proportional solenoid valve control system in accordance with a first preferred embodiment of the present invention.

The overall compositions and operations of the proportional solenoid valve control system in accordance with a first preferred embodiment of the present invention will be described below with reference to FIG. 1.

The proportional solenoid valve control system according to the first preferred embodiment of the present invention is comprised of main circuitry 100 and control circuit 200. The main circuitry 100 is comprised of field effect transistors M1 and M2 which are respectively connected to proportional solenoid valves PV1 and PV2. Transistors M1 and M2 are connected through respective valves PV1 and PV2 to current detection resistor Rs.

The gate terminals of field effect transistors M1 and M2 are respectively connected to output terminals OUT1 and OUT2 of control circuit 100. The resistors R111 and R114 are connected between the gate terminals of M1 and M2 and output terminals OUT1 and OUT2, respectively. Each source terminal of field effect transistors M1 and M2 is connected to supply voltage Vdc. The resistors R112 and R113 are located between the source terminal and the gate terminals of transistors M1 and M2, respectively. The diodes D1 and D2, and proportional solenoid valves PV1 and PV2, are connected in parallel to each respective drain terminal of transistors M1 and M2. The proportional solenoid valves PV1 and PV2 are connected to current detection resistor Rs and through a back contact thereof.

The control circuit 200 connected to the supply voltage Vdc of main circuitry 100 has power supply part 10 which provides power to each part of control circuit 200.

As to a connection state between each part of control circuit 200, current command detection circuit 20 has current command $V_{CMD}$ and a reference voltage $V_{CMDref}$ as inputs, and its output terminal is connected to rectifier 30. Output terminals of rectifier 30 are connected to current command mode determining means 40 and offset circuit 41. Output terminals of current command mode determining means 0 are connected to offset circuit 41 and output circuit 92. The current command adding and limiting circuit 42 receives inputs from both offset circuit 41 and second triangular pulse generating circuit 50, and its output terminal is connected to PI controller 80. Current detection circuit 70, which is connected to current detection resistor Rs of main circuitry 100, has an output connected to PI controller 80. The pulse width modulation circuit 90 receives input signals from both PI controller 80 and first triangular pulse generating circuit 60, and its output terminal is connected to output circuit 92. The output terminals OUT1 and OUT2 of output circuit 92 are respectively connected to gate terminals of field effect transistors M1 and M2 in main circuitry 100.

First, with respect to the operation of main circuitry 100, field effect transistors M1 and M2 are controlled by a voltage applied through output terminals OUT1 and OUT2 of output circuit 92. The currents Ip1 and Ip2 flowing respectively in each source terminal of field effect transistors M1 and M2 are determined by the duty ratio of a voltage applied to the gate terminal.

Any one of valves PV1 and PV2 is operated by the current flowing in the source terminals of transistors M1 and M2, and the open/close degree of the operated proportional solenoid valve corresponds to the current quantity. The current detection resistor Rs detects a current flowing in the operated proportional solenoid valve.

Next, control circuit 200 amplifies the difference between current command $V_{CMD}$ and reference voltage$_{CMDref}$ which are inputted from the outside. The rectifier 30 rectifies output signal of current command detection circuit 20, and then provides the rectified signal to offset circuit 41 and current command mode determining means 40.

The current command mode determining means 40 determines a current command mode from its input signal, and then provides the determined current command mode output circuit 92. There are three different current command modes: a fully closed mode for completely closing either PV1 or PV2, a proportionally open mode for controlling the degree of openness of the valve in proportion to the current quantity, and a fully open mode for completely opening either PV1 or PV2. In the current command modes one valve operates, and the other valve does not operate.

The offset circuit 41 receives the output signals from both rectifier 30 and the current command mode determining means 40 and generates the offset signal controlling current applied to respective solenoid valves PV1 and PV2 in main circuitry 100 for those currents to be equal to each other.

Figure 2A:
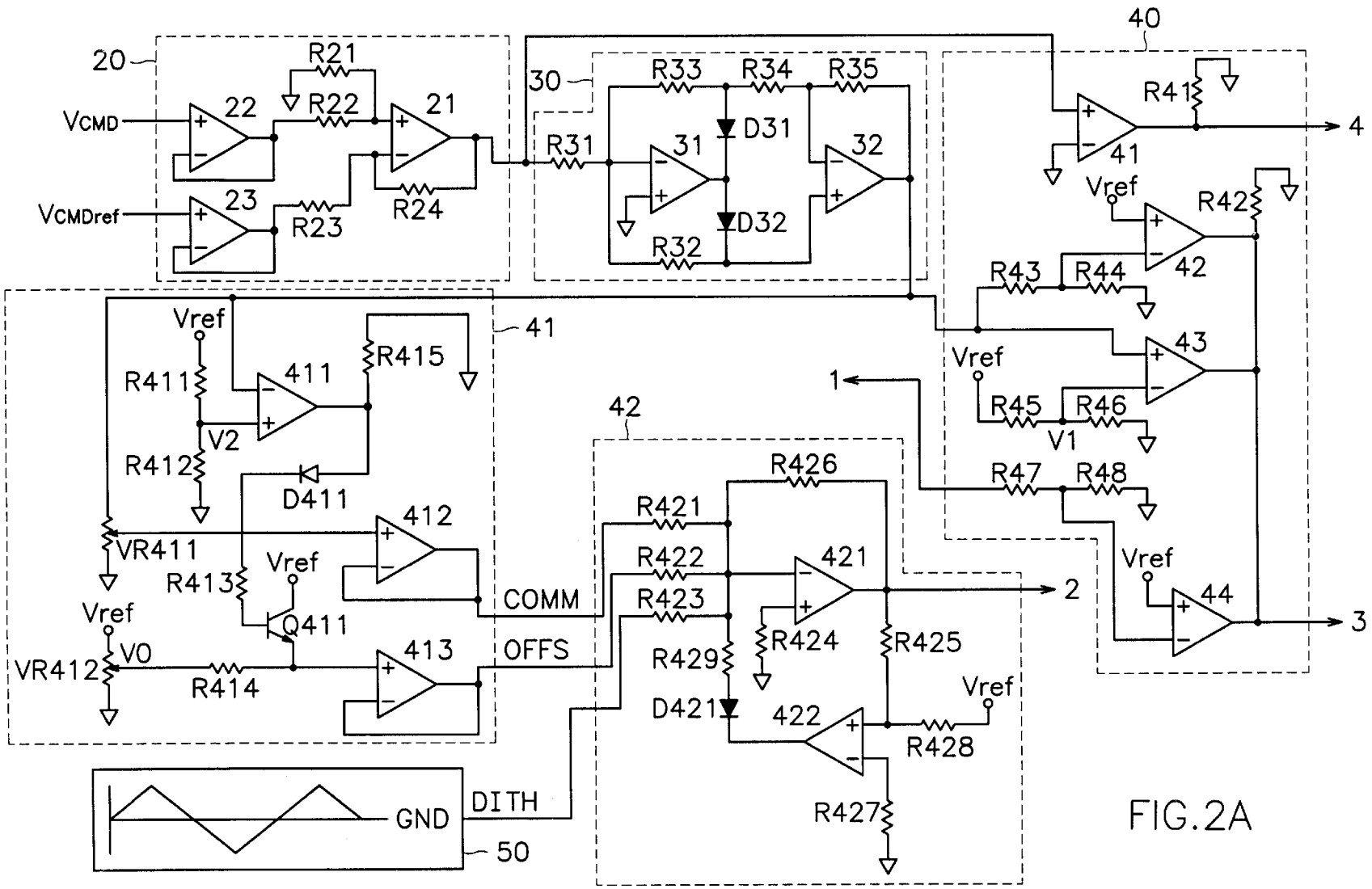
FIGS. 2A and 2B are detailed circuit diagrams of a control circuit of the proportional solenoid valve control system in accordance with the first preferred embodiment of the present invention.

As shown in FIG. 2A, current command adding and limiting circuit 42 receives an OFF-command (413-output) and a COMM-command (412-output) of offset circuit 41, and the output signal of second triangular pulse generating circuit 50 as inputs. Then, circuit 42 adds the above three signals. If the external current command CMD is applied excessively, control circuit 200 restricts the excessive CMD by using a fixed maximum current command value CMD-max. The PI controller 80 amplifies the difference between the output signals of current command adding and limiting circuit 42 and current detection circuit 70. The output signal of current command adding and limiting circuit 42 is a current command. The output signal of current detection circuit 70 is equal to the currents flowing in proportional solenoid valves PV1 or PV2.

The pulse width modulation comparator 90 receives the output signal of PI-controller 80 and the output signal of first triangular pulse-generating circuit 60 as inputs, and compares them. The output signal of pulse width modulation comparator 90 corresponds to the output level of PI-controller 80, thereby determining pulse width. According to a mode determined by current command mode determining means 40, the output circuit 92 generates signals OUT1 and OUT2 for operating field effect transistors M1 and M2 of main circuitry 100, in accordance with the output signal of pulse width modulation comparator 90.

The output signals OUT1 and OUT2 of output circuit 92 are applied to field effect transistors M1 and M3 of main circuitry 100.

FIG. 2A is a detailed circuit diagram showing current command detection circuit 20. Rectifier 30, current command mode determining means 40, offset circuit 41, second triangular pulse generating circuit 50, and current command adding and limiting circuit 42 in a control circuit of the proportional solenoid valve control system in accordance with a preferred embodiment of the present inventions.

Figure 2B:
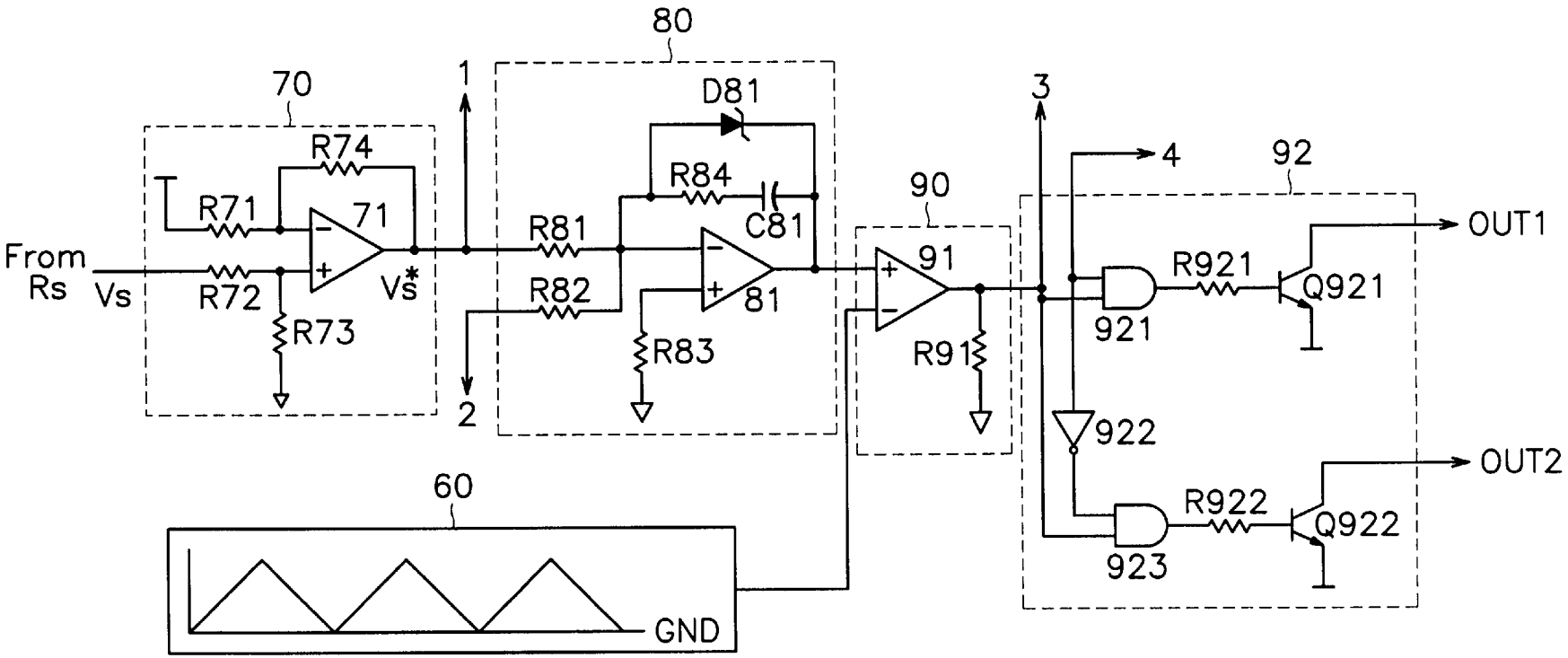

FIG. 2B is a detailed circuit diagram showing current detection circuit 70, the PI-controller 80, the pulse width modulation circuit 90, first triangular pulse generating circuit 60, and output circuit 02 in a control circuit of the proportional solenoid valve control system in accordance with a preferred embodiment of the present invention.

The circuit branches shown interrupted at reference numbers 1, 2, 3, and 4 of FIG. 2A are connected to the corresponding reference numbers of FIG. 2B. Positive and negative voltages are inputted to the operational amplifiers shown in FIGS. 2A and 2B, that are not shown in the other drawings.

As shown in FIG. 2A, the current command detection circuit 20 is comprised of operational amplifiers 21 to 24 and resistors R21, R22, R23, and R24. The current command $V_{CMD}$ and reference voltage $V_{CMDref}$ are inputted to the negative input terminals of operational amplifiers 22 and 23. The output terminals of amplifiers 22 and 23 are connected to inverting and noninverting terminals of operational amplifier 21 through two resistors R22 and R23. The operational amplifier 22 and 23 are buffers which transfer input voltages to operational amplifier 21. The operational amplifier 21 amplifies and outputs the voltage difference between its inverting terminal and noninverting terminal. The resistor R24 is connected between the output terminal and the inverting terminal of operational amplifier 21. The resistor R21 of which terminal is grounded, is connected to the inverting terminal of amplifier 21.

The rectifier 30 is comprised of diodes D31 and D32, operational amplifiers 31 and 32, and resistors R31 to R35. The inverting terminal of operational amplifier 31 is connected to the output terminal of the current command detection circuit 20 through the resistor R31, and its output terminal is connected to a contact between diodes D31 and D32. Diodes D31 and D32 are connected through resistor R33 and R32 respectively, to the inverting terminal of operational amplifier 31. The inverting terminal of operational amplifier 32 is connected through resistor R34 to a contact between resistor R33 and diode D31. The noninverting terminal of operational amplifier 32 is connected to diode D32. The resistor R35 is located between the inverting terminal and the output terminal of operational amplifier 32. The output signal of operational amplifier 32 is applied to current command mode determining means 40 and offset circuit 41.

The operational amplifier 31 amplifies inversely the output signal of current command detection circuit 20. The diode D31 rectifies the negative voltage of operational amplifier 31. The diode D32 rectifies the positive voltage of operational amplifier 31. The operational amplifier 32 adds the output signals from diodes D31, and D32, that is, it operates as an adder.

The current command mode determining means 40 includes operational amplifiers 41 through 44, and resistors R41 through R48. Here, operational amplifier 41 uses the output signal of current command detection circuit 20 as a noninverting input. The resistor R41 is connected to the output terminal of operational amplifier 41. The output terminal of rectifier 30 is connected to the noninverting terminal of operational amplifier 43, and to the inverting terminal of operational amplifier 42 through resistor R43. The resistors R45 and R46 are connected to the inverting terminal of operational amplifier 43. The output signals of the operational amplifiers 42, 43, and 44 are connected to one another, and they are applied to output circuit 92 (See FIG. 26) The output signal of operational amplifier 41 is also applied to output circuit 92. The output signal of current detection circuit 70 is connected to the inverting terminal of operational amplifier 44 through resistors R47 and R48.

The operational amplifier 41 amplifies noninversely the signal of the noninverting terminal. The operational amplifiers 42, 43, and 44 each operate as a comparator. The is, operational amplifier 42 compares the voltage of its own inverting terminal with that of its own noninverting terminal. The operational amplifier 43 compares the voltage V1 of its inverting terminal with the voltage of its noninverting terminal. The operational amplifier 44 compares the voltage of its inverting terminal which is equal to the output signal of current detection circuit 70, with the voltage of noniverting terminal. The current command mode is determined by a combination of the output signal of operational amplifier 41 and the common output signal of operational amplifiers 42, 43, and 44.

The offset circuit 41 includes operational amplifiers 411, 412, and 413. The operational amplifier 411 receives the output signal of rectifier 30 as an input, which output signal is applied to a base terminal of transistor Q411. The operational amplifier 413 receives the emitter signal of transistor Q411 as a noninverting input. The noninverting terminal of operational amplifier 412 is connected to the output signal of rectifier 30 through a variable resistor VR411. A resistor R415, of which one terminal is grounded, is connected to the output terminal of operational amplifier 411. A diode is connected between the output terminal of amplifier 411 and the base terminal of transistor Q411. The noninverting terminal of operational amplifier 413 is connected to variable resistor VR412 through resistor R414. The output signals of operational amplifiers 412 and 413 are applied to current command adding and limiting circuit 42.

Figure 3:
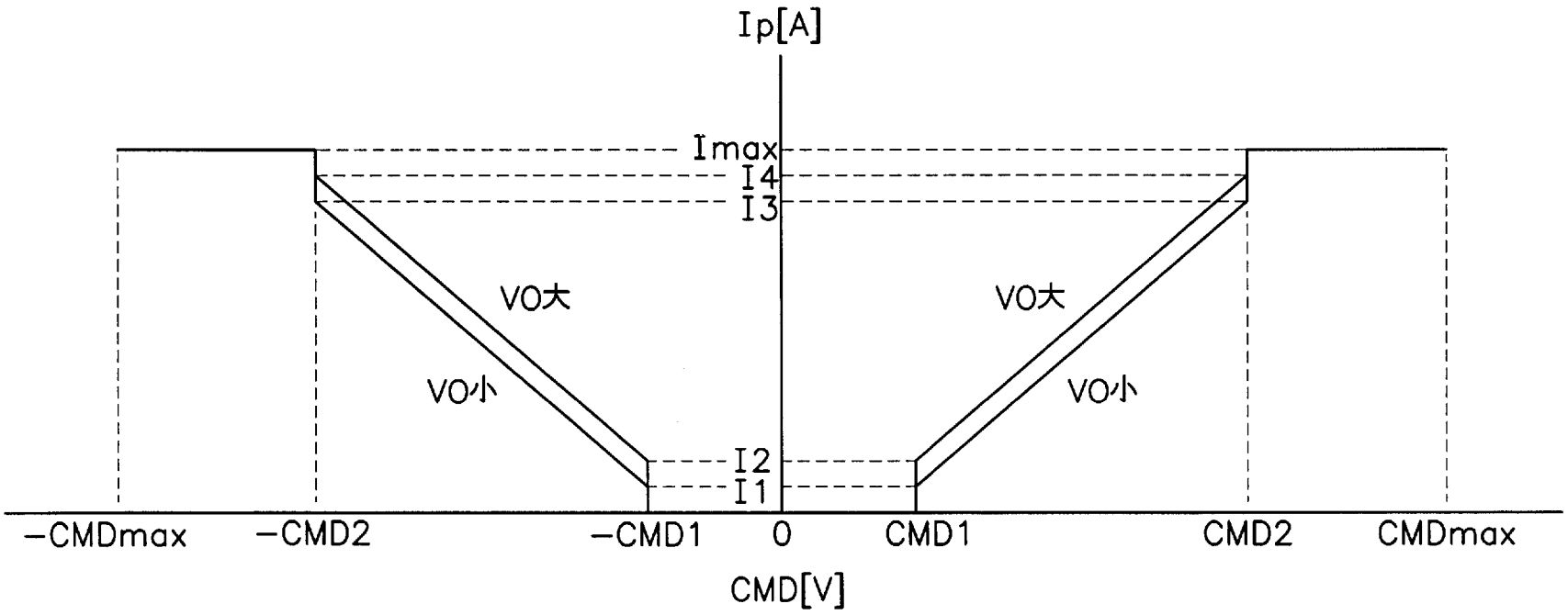
FIGS. 3 to 5 are graphs of load current versus current command regarding the proportional solenoid valve control system in accordance with the first preferred embodiment of the present invention.

The operational amplifier 411 operates as a comparator which uses the voltage V2 applied to the noninverting terminal as a reference. The voltage V2 is determined by resistors R411 and R412 and reference voltage Vref. The operational amplifiers 412 and 413 operate as voltage followers. The transistor Q411 performs a switching operation. The transistor Q411 is turned on or off according to the output voltage of operational amplifier 411. Since the offset voltage V0 varies according to the resistance value of variable resistor VR412, variable resistor VR412 can control the offset degree of current flowing in proportional solenoid valves PV1 and PV2. That is, as shown in FIG. 3, current flowing in the actual load varies according to the variance of offset voltage V0.

The second triangular pulse generating circuit 50, which is not shown in the drawings because this circuit is well known to those skilled in the art, generates a triangular pulse running repeatedly positive and negative.

The current command during and limiting circuit 42 includes the operational amplifier 421 which uses two output signals of the offset circuit 41 and output signals of second triangular pulse generating circuit 50 as an inverting input, diode D421 and operational amplifier 422 which are connected to the inverting terminal of amplifier 421, and resistor R421 to R429 connected to the above-described elements.

The operational amplifier 421 adds the output signals at the inverting terminal, that is, it is an adder. If one of the input signals of the inverting terminal of the operational amplifier is beyond a predetermined level, diode D421 is turned on thereby limiting the input voltage of operational amplifier 421. That is, if the voltage of the inverting terminal of operational amplifier 421 is higher than the voltage of the output terminal of operational amplifier 422, diode D421 is turned on. Accordingly, the output signal of operational amplifier 422 is applied to the inverting terminal of operational amplifier 421. The output signal of the amplifier 421 is applied to PI-controller 80.

Figure 4:
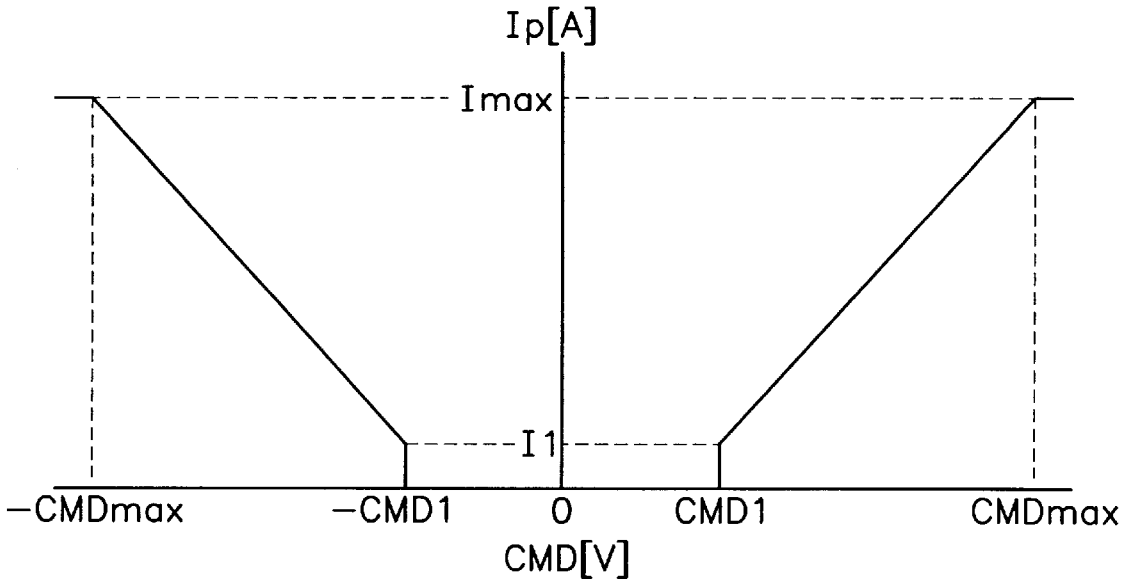
Figure 5:
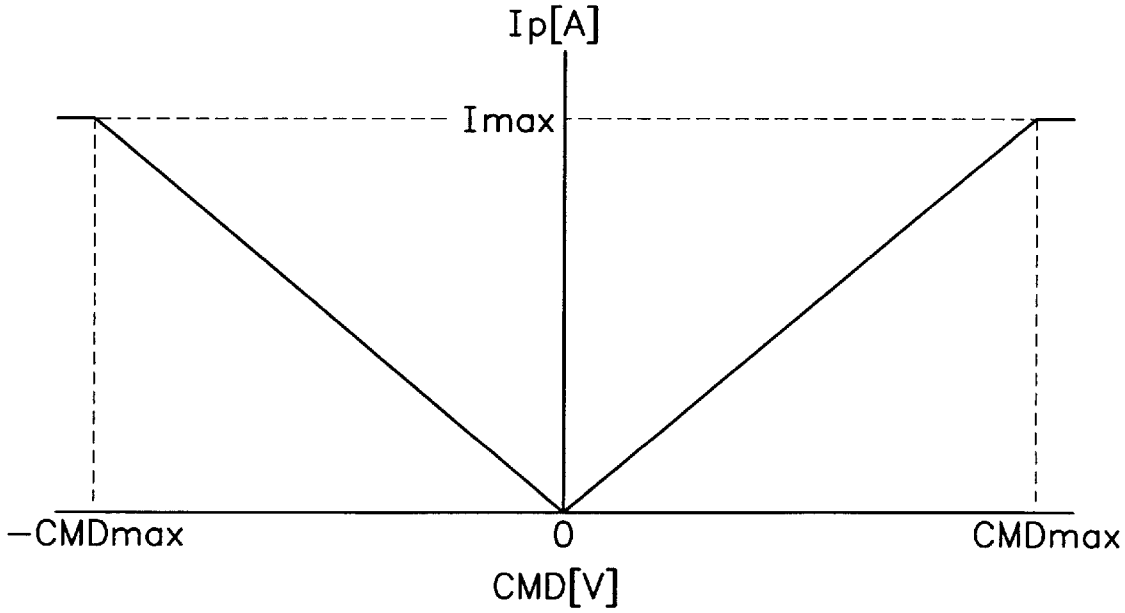

FIGS. 3 to 5 show a relation between current command CMD and load current Ip. More particularly, they show the variation of load current Ip in response to the voltages V0, V1, and V2 of current command mode determining means 40 and offset circuit 41.

FIG. 3 depicts load current Ip when voltage V1 of current command mode determining means 40 is equal to CMD1 and voltage V2 of offset circuit 41 is equal to CMD2.

FIG. 4 depicts load current Ip when voltage V1 of current command mode determining means 40 is equal to CMD1 and voltage V2 of offset circuit 41 is equal to CMDmax.

FIG. 5 depicts load current Ip when voltage V1 of current command mode determining means 40 is equal to zero and voltage V2 of offset circuit 41 is equal to CMDmax.

As shown in FIGS. 3 to 5, the load current can be controlled by adjusting voltages V0 to V2 of current command mode determining means 40 and offset circuit 41. In addition, voltages V0 and V2 can be controlled by resistors R45 and R46, R411 and R412, and variable resistor VR412.

As shown in FIG. 2B, current detection circuit 70 includes operational amplifier 71 and resistors R71 to R74. A signal is applied through current detection resistor Rs of main circuitry 100 to the noninverting input of operational amplifier 71.

The operational amplifier 71 detects current flowing through current detection resistor RS by using voltage Vs, and amplifies the input signal noninversely. The output signal Vs* of operational amplifier 71 is applied to PI controller 80, where, if (G) is R74/R71 and R73=R74, VS*=G×Vs.

The PI controller 80 includes operational amplifier 81 for receiving simultaneously the output signals of current detection circuit 70 and current command adding and limiting circuit 42 through its own inverting terminal, resistor R84, diode D81, capacitor C81, which are connected to the inverting input terminal and the output terminal of operational amplifier 81, resistor R81, R82, and R83 connected to the inverting and noninverting terminals of operational amplifier 81.

The operational amplifier 81 operates as an adder adding the input signals of the inverting terminal, detects an error between the input signals, and compensates for output signal of amplifier 81. By such error compensation, accordion to the current command, load currents Ip1 and Ip2 are maintained constant irrespective of supply voltage Vdc and load variation. The output signal of operational amplifier 81 is applied to pulse width modulation comparator 90.

The pulse width modulation comparator 90 is comprised of operational amplifier 91 for using the output signal of PI-controller 80 as noninverting input, and also uses the output signal of first triangular pulse generating circuit 60 as an inverting input, and resistor R91 of which one terminal is connected to the output terminal of amplifier 91.

The first triangular pulse generating circuit 60, which is not shown in drawings because this circuit is well known to those skilled in the art, generates the first triangular pulse shown in FIG. 2B.

The voltage of the noninverting input terminal of operational amplifier 91 in pulse width modulation comparator 90 is a reference voltage. The operational amplifier 91 operates as a comparator. That is, the pulse width of the output terminal varies according to the voltage level of the noninverting terminal of the operational amplifier. The signal of amplifier 91, which is pulse width modulated, is applied to output circuit 92.

The output circuit 92 includes an inverter 922 for receiving the output signals of operational amplifier 41 of current command mode determining means 40 as an input; AND gate 921 for receiving the output signals of operational amplifier 41 and pulse width modulation comparator 90 as an input; AND gate 923 for receiving the output signals of pulse width modulation comparator 90 and inverter 922 as an input; transistor Q921 for receiving the output signal of the AND gate 921 at its own base terminal and outputting output signal OUT1 at its own collector terminal; and a transistor Q922 for receiving the output signal of AND gate 923 at its own base terminal and outputting output signal OUT2 at its own collector terminal.

The inverter 922 performs an inverting operation for its own input signals. The AND gated 921 and 923 perform a logic AND operation for their won signals. The output signal of current command mode determining means 40 is input to AND gates 921 and 923. The transistors Q921 and Q922 perform a switching operation according to the pulse width modulated signal which is transmitted through each of AND gates 921 and 923. Namely, according to the duty ratio outputted from pulse width modulation comparator 90, each of transistors 921 and Q922 determines a turn-on time, and output signals of transistors Q921 and Q922 are supplied to main circuitry 100. The current quantity flowing in field effect transistors M1 and M2 of main circuitry 100 is determined by the duty ratio of the output signals of transistors Q921 and Q922.

Next, another preferred embodiment of the present invention is described below with reference to the accompanying drawings.

Figure 6:
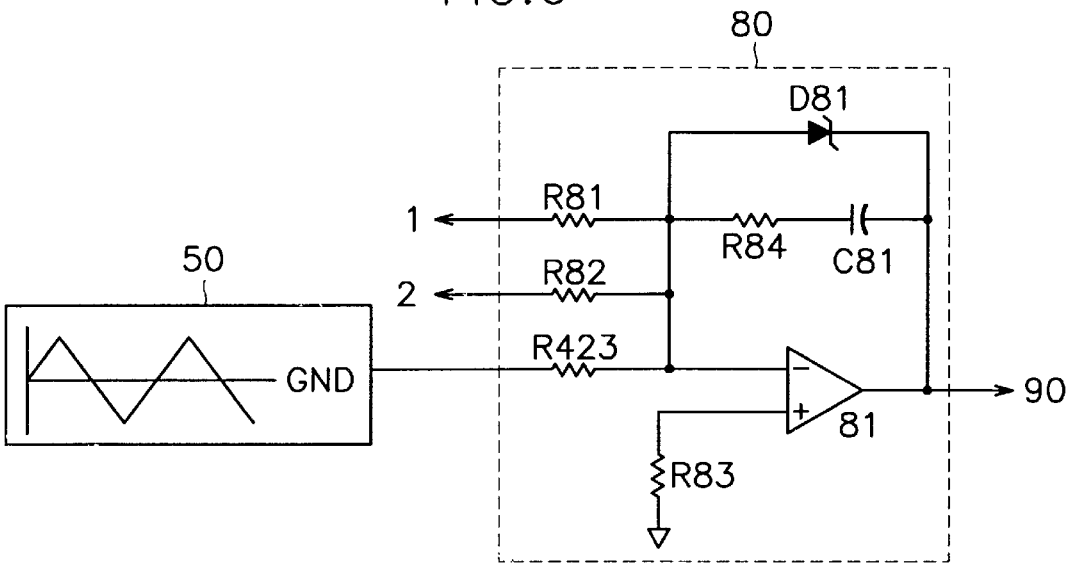
FIG. 6 is a detailed circuit diagram showing partially the control circuit of the proportional solenoid valve control system in accordance with a second preferred embodiment of the present invention.

FIG. 6 is a detailed circuit diagram showing partially the control circuit of the proportional solenoid valve control system in accordance with another preferred embodiment of the present invention.

Figure 7:
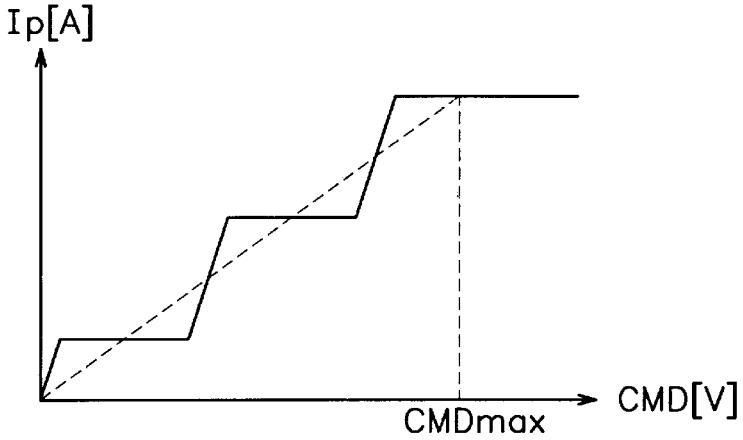
FIGS. 7 and 8 and graphs of load current versus current command regarding the proportional solenoid valve control system in accordance with the first and second preferred embodiments of the present invention.
Figure 8:
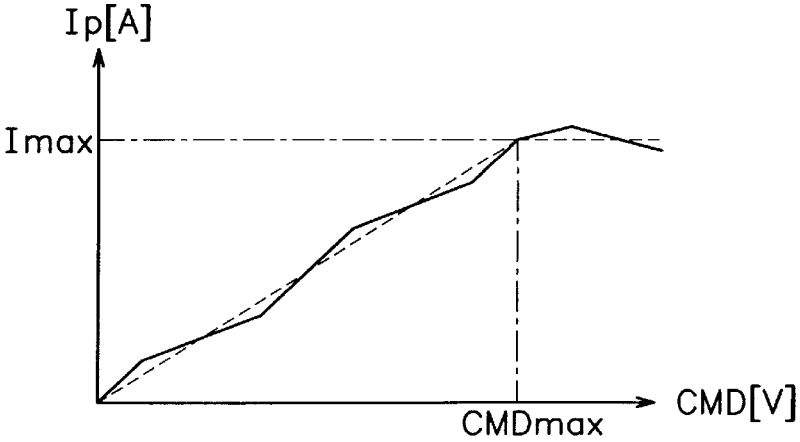

FIGS. 7 and 8 are graphs of the load current versus the current command regarding the proportional solenoid valve control system in accordance with the first and second preferred embodiments, respectively.

The second preferred embodiment of the present invention improves the control circuit of the proportional solenoid valve control system. A dither effect is generated in a field in which the current command CMD is higher than the maximum current command valve CMDmax.

The dither effect decreases impacts of both friction and sticking of a valve thereby improving its hysteresis characteristics. Thus, oscillation is added to a signal applied to main circuitry 100 through control circuit 200.

The dither effect according to the present invention is generated if the current command CMD is lower than the maximum current command CMDmax, because the current command CMD is limited by current command adding and limiting circuit 42 if the current command CMD is higher than the maximum current command CMDmax after second triangular pulse generating circuit 50 deriving dither effect is inputted tot he current command adding and limiting circuit 42.

According to the second preferred embodiment of the present invention, the dither effect is also generated in case the current command is higher than the maximum current command CMDmax. That is, as shown in FIG. 8, this embodiment generates the load current Ip in response to the current command CMD.

As shown in FIG. 6, the output terminal of second triangular pulse generating circuit 50 is connected to the input terminal of PI controller 80. More particularly, the output terminal of second triangular pulse generating circuit 50 is connected to the inverting terminal of amplifier 81 of PI controller 80 through resistor R423. The second pulse-triangular generating circuit 50 is also connected to current command adding and limiting circuit 42.

That is, since the output signal of current command adding and limiting circuit 42, the output signal of current command mode determining means 40, and the output signal of second triangular pulse generating circuit 50 are inputted to PI controller 80, dither effect is generated to the load current Ip in response to all ranges of the current command CMD.

As a result, in case the current command CMD is higher than the maximum current command CMDmax by means of second triangular pulse generating circuit 50 of FIG. 6, the dither effect is generated to load current Ip.

As described above, the proportional solenoid valve control system can precisely control the load current flowing in a proportional solenoid valve in accordance with the current command.

What is claimed is:

1. A proportional solenoid valve control system, comprising:

a current command detection circuit for detecting a differential voltage between a received current command and reference voltage;

a rectifier for rectifying the current command detected by said current command detection circuit;

an offset circuit for generating an offset signal through the rectified current command signal of said rectifier;

a current command adding and limiting circuit for adding the generated offset signal and a triangular pulse signal generated from a second triangular pulse generating circuit;

a current detection circuit for detecting current flowing in each load of a main circuitry;

a proportional integrator-controller for amplifying an error between the added signal from said current command adding and limiting circuit and a signal from said current detection circuit;

a pulse width modulation comparator for comparing the error signal received from said proportional integrator-controller with a signal received from a first triangular pulse generating circuit; and;

an output circuit for generating a switching element driving signal having a duty ratio corresponding to the compared signal received from said pulse width modulation comparator for operating proportional solenoid valves of said proportional solenoid valve control system.

2. The proportional solenoid valve control system as defined in claim 1, further comprising a current command mode determining means located between said rectifier and said output circuit, for determining an operating mode of the current command, and transmitting the determined operating mode to said output circuit.

3. The proportional solenoid valve control system as defined in claim 2, wherein said current command mode determining means is arranged to determine one among three modes, which are: a fully open mode for completely opening one of two proportional solenoid valves, a proportionally open mode for enabling one of said two proportional solenoid valves to open proportionally, and a fully closed mode for completely closing one of said two solenoid valves.

4. The proportional solenoid valve control system as defined in claim 1, wherein said current command detection circuit comprises:

two operational amplifiers for receiving a current command and a reference voltage as a buffer and providing respective output voltages;

an operational amplifier for receiving the output voltages of the two operational amplifiers through inverting and noninverting terminals of said operational amplifier, applying a resulting output signal to said current command detection circuit, and amplifying a difference between the two inputted voltages; and resistors which are connected to the inverting terminal, or the noninverting terminal, or the output terminal of said operational amplifier.

5. The proportional solenoid valve control system as defined in claim 1, wherein said rectifier comprises:

an operational amplifier for amplifying inversely the output signal of said current command detection circuit;

diodes for rectifying each of positive and negative signals among the output signals of said operational amplifier; and an operational amplifier for adding the signals rectified by said diodes.

6. The proportional solenoid valve control system as defined in claim 1, wherein said offset circuit comprises:

a first operational amplifier for comparing the output signal of said rectifier to a reference voltage;

a second operational amplifier for receiving the output signal of said rectifier as an noninverting input, and connecting its inverting input to an output terminal of said second operational amplifier;

a transistor for alternatively turning on or off according to an output voltage received from said first operational amplifier;

a third operational amplifier for receiving an output voltage from said transistor as a noninverting input, and connecting its inverting input to an output terminal of said third operational amplifier; and a variable resistor connected to the noninverting input terminal of said third operational amplifier, for varying the voltage of the noninverting input terminal.

7. The proportional solenoid valve control system as defined in claim 1, wherein said current command adding and limiting circuit comprises:

a first operational amplifier for adding the output signal of said offset circuit to that of said second triangular pulse generating circuit, which are inputted through an inverting terminal of said first operational amplifier;

a diode connected to said inverting terminal of said first operational amplifier, which is turned on if the voltage of said inverting terminal is higher than a predetermined level; and a second operational amplifier connected to said diode, which applies a reference voltage limiting the current command to said inverting terminal of said first operational amplifier when said diode is turned on.

8. The proportional solenoid valve control system as defined in claim 1, wherein said current detection circuit comprises:

an operational amplifier for receiving as an input voltage a voltage of a current detection resistor as noninverting input, and amplifying noninversely the input voltage; and resistors for connecting an inverting terminal, or a noninverting terminal, or between said inverting terminal and the output terminal of said operational amplifier.

9. The proportional solenoid valve control system as defined in claim 1, wherein said proportional integrator-controller comprises:

an operational amplifier for receiving the output signals of said current detection circuit and said current command adding and limiting circuit as an inverting input, and adding said output signals;

resistors for connecting an inverting terminal, or a noninverting terminal, or between said inverting terminal and the output terminal of said operational amplifier; and a diode and capacitor which are connected between said inverting terminal and said output terminal of said operational amplifier.

10. The proportional solenoid valve control system as defined in claim 1, wherein said pulse width modulation comparator comprises an operational amplifier for using the output signal of said proportional integrator-controller as noninverting input, using the output signal of said first triangular generating circuit as an inverting input, using a voltage of said noninverting input terminal as a reference voltage, and comparing a voltage of said inverting input terminal.

11. The proportional solenoid valve control system as defined in claim 1, wherein said output circuit comprises:

a NAND gate for receiving the output signal of said current command mode determining means as a common input, and performing a logic NAND operation for the received signals;

a first AND gate for receiving the output signals of both said pulse width modulation comparator and said current command mode determining means as an input, and performing a logic AND operation for the received signals;

a second AND gate for receiving the output signals of both said pulse width modulation comparator and said NAND gate as an input, and performing a logic AND operation for the received signals;

a first transistor for receiving the output signal of said first AND gate through its own base terminal, and alternatively turning itself on or off according to the received voltage; and a second transistor for receiving the output signal of said second AND gate through its own base terminal, and alternatively turning itself on or off according to the received voltage.

12. A proportional solenoid valve control system, comprising:

a current commend detection circuit for detecting a received current command;

a rectifier for rectifying a current command detected by said current command detection circuit;

an offset circuit for generating an offset signal in accordance with an output signal received from said rectifier;

first and second triangular pulse generating circuits, each for generating a respective triangular pulse wave;

a current command adding and limiting circuit for adding the output signal from said offset circuit and a triangular pulse signal generated from said second triangular pulse generating circuit;

a current detection circuit for detecting a current flowing in each load of a main circuitry;

a proportional integrator-controller for adding an output signal received from said current command adding and limiting circuit, an output signal from said current detection circuit, and the triangular pulse signal from said second triangular pulse generating circuit, and amplifying an error between said signals;

a pulse width modulation comparator for comparing an output signal of said proportional integrator-controller with an output signal of said first triangular pulse generating circuit; and an output circuit for generating a switching element driving signal having a duty ration corresponding to an output signal of said pulse width modulation comparator for operating proportional solenoid valves of said proportional solenoid valve control system.

13. The proportional solenoid valve control system as defined in claim 12, wherein said proportional integrator-controller comprises:

an operational amplifier for receiving the output signal of said current detection circuit, the output signal of said current command adding and limiting circuit, and the output signal of said second triangular pulse generating circuit as an inverting input, and adding said three output signals;

resistors for connecting an inverting terminal, and transmitting the input signal to said operational amplifier; and a diode and capacitor which are connected between said inverting terminal and said output terminal of said operational amplifier.

* * * * *